United States Patent [19]

Mizelle

[11] 4,218,790

[45] Aug. 26, 1980

[54] BOX SPRING ASSEMBLY WITH IMPROVED STIFFNESS CHARACTERISTICS

[75] Inventor: Ned W. Mizelle, Lexington, Ky.

[73] Assignee: Hoover Universal, Inc., Saline, Mich.

[21] Appl. No.: 36,669

[22] Filed: May 7, 1979

[51] Int. Cl.[3] ..... A47C 23/02

[52] U.S. Cl. ..... 5/247; 5/255; 5/260

[58] Field of Search ..... 5/247, 255, 260, 264 R; 267/97, 102, 107

[56] References Cited

U.S. PATENT DOCUMENTS

| | | | |
|---|---|---|---|
| 3,574,241 | 4/1971 | Slominski | 5/247 |
| 3,680,157 | 8/1972 | Slominski et al. | 5/247 |
| 3,852,838 | 12/1974 | Slominski | 5/247 |

*Primary Examiner*—Casmir A. Nunberg
*Attorney, Agent, or Firm*—Olsen and Stephenson

[57] ABSTRACT

A box spring assembly which includes a generally rectangular frame, a plurality of wire springs mounted on the frame and connected to each other so as to yieldably resist downwardly directed bedding loads. Each of the springs has an elongated body portion arranged above the frame and downwardly extending end portions, each of the end portions having an upper section and a lower section which are located in planes that are upright and generally perpendicular to each other with each of the sections being comprised of integral legs arranged in a generally V-formation rotated about ninety degrees and with the included angle between the legs being less than ninety degrees. This construction enables the spring end portions to yieldably resist bedding loads with both bending and torsional stresses thereby enabling increased load-resisting capabilities in the spring end portions with a resulting efficient use of spring wire material.

6 Claims, 6 Drawing Figures

BOX SPRING ASSEMBLY WITH IMPROVED STIFFNESS CHARACTERISTICS

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; and 3,852,838. Box spring assemblies of the general type shown in the above list of patents, all of which are assigned to the assignee of this application, are advantageous with respect to the conventional box spring assemblies using coil springs because they provide a desired stiffer foundation of the mattress and contain a reduced amount of wire. These box spring assemblies are also advantageous from the standpoints of prolonged service life, ease of assembly and cost of manufacture.

Additional box spring assemblies of this general type are shown in U.S. Pat. Nos. 3,596,299; 3,722,013; 3,825,960; 3,833,948; 3,835,485, 3,869,740; 3,990,121; and 4,000,531.

The present invention provides a box spring assembly which utilizes a different spring from the formed wire springs utilized in the patented box spring assemblies discussed above. The spring in the present box spring assembly is a stiffer spring than springs heretofore used, this increased stiffness being an inherent feature of the spring achieved by virtue of the spring configuration. Furthermore, this increased stiffness is achieved without any reduction in the usual height of the box spring assembly, and enables the production of firmer box spring assemblies from less raw material.

It is an object of the present invention, therefore, to provide an improved box spring assembly having increased resistance to bedding loads and requiring a decreased amount of raw material relative to prior art structures.

SUMMARY OF THE INVENTION

The box spring assembly of this invention consists of a generally horizontal rectangular frame and a plurality of wire springs mounted on the frame and connected to each other so as to yieldably resist downwardly directed bedding loads, each of the springs being formed of spring steel wire having an elongated body portion arranged above the frame and downwardly extending end portions secured to the frame. Each of the spring end portions has an upper section and a lower section which are located in planes that are upright and generally perpendicular to each other, each of the sections being comprised of integral legs arranged in a generally V-formation that is rotated about ninety degrees with respect to the horizontal. The included angle between the legs in each of the sections is less than ninety degrees so that the legs can be bent toward each other. As a result, the included angle between the legs in each section is decreased in response to the application of a downwardly directed bedding load to the upper end of the end section.

The end sections are connected so that in response to load, they will twist as well as bend and are mounted to the frame by means of a torsion bar. This enables the end sections to resist bedding loads by means of both tensile and shear stresses induced in the spring end portions. This dual capability of the spring end portions to accommodate both shear and tensile stresses of substantial magnitudes enables the spring end portions to yieldably resist bedding loads with a reduced amount of spring material. In addition, each spring imparts increased stiffness to the box spring assembly without danger of taking a set, namely, incurring permanent deformation in response to load. Increased firmness is particularly desirable from a bedding comfort standpoint since the comfort qualities of "hard" box spring assemblies are becoming more and more appreciated.

Each spring assembly includes main springs arranged on the frame so that the angularly extending end sections are adjacent to the periphery of the frame and are secured to the top side of the frame. A conventional rectangular border wire is secured to and extends between the end portions of the springs at a position overlying the frame and adjacent the periphery of the frame. Intermediate springs are mounted on the frame at positions spaced from the border wire so as to support the main springs intermediate their ends.

Further objects, features, and advantages of this invention will become apparent from a consideration of the following description, the appended claims, and the accompanying drawing in which:

Figure 4:
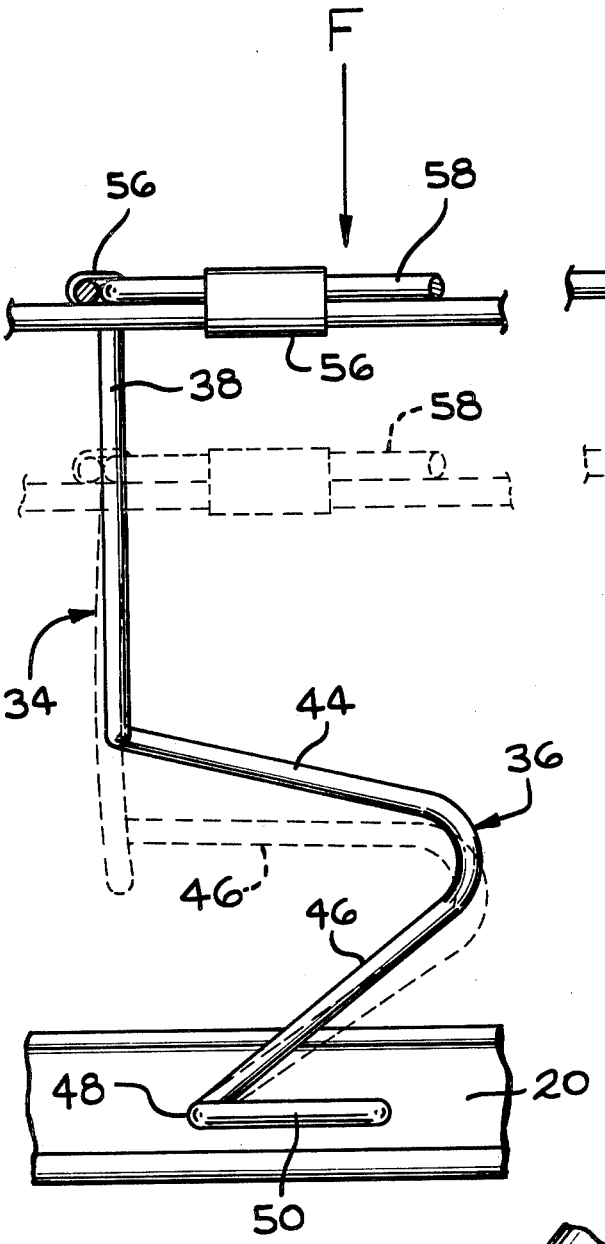
Figure 5:
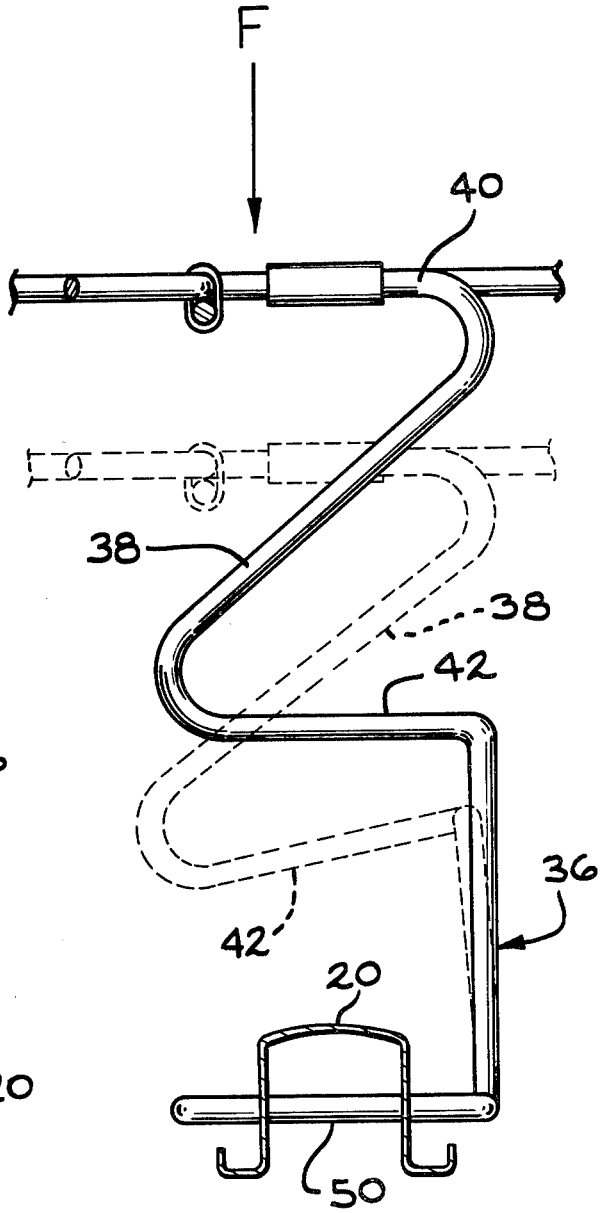
Figure 6:
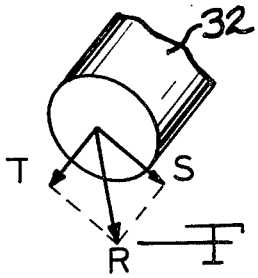

FIGS. 4 and 5 are sectional views, taken at right angles with respect to each other, of a portion of the box spring assembly of this invention illustrating the shape of a spring end portion, with the spring end portion being shown in an undeflected position in solid lines and a loaded position in broken lines; and FIG. 6 is a diagrammatic view of a portion of a wire spring in the box spring assembly of this invention, showing the tensile and shear stresses induced in the spring member when subjected to load and illustrating the increased ability of the spring to resist bedding loads when the spring reacts in both bending and torsion.

Figure 1:
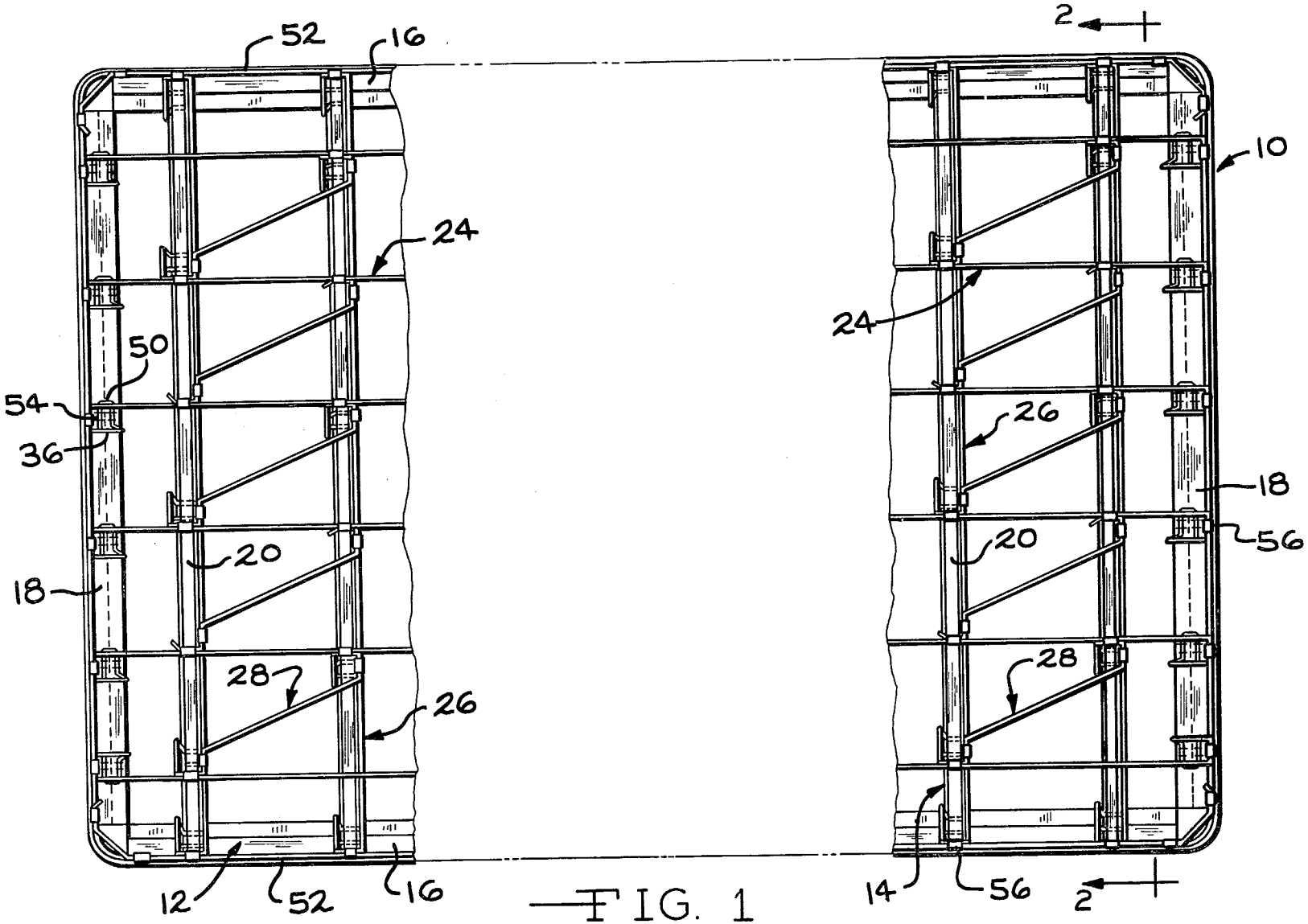
FIG. 1 is a plan view of the box spring assembly of this invention with the middle portion of the spring assembly being broken away for ease of illustration.
Figure 2:
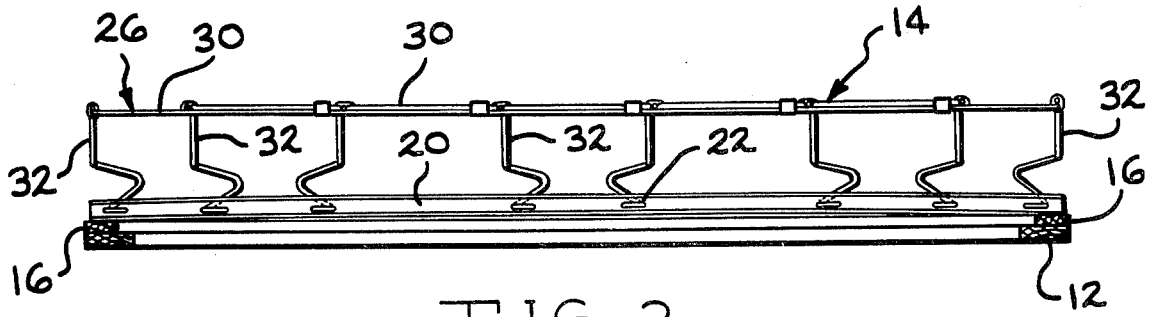
FIG. 2 is a transverse sectional view of the box spring assembly of this invention as seen from substantially the line 2—2 in FIG. 1.

With reference to the drawing, the spring assembly of this invention indicated generally at 10, is illustrated in FIG. 1 as consisting of a generally rectangular horizontally disposed frame 12, usually formed of wood, and a wire spring assemblage 14 mounted on the top side of the frame 12. The frame 12 has side rails 16, end rails 18, and cross rails 20 which are secured to and extend between the side rails 16. The cross rails 20 are shown in the assembly 10 as being formed of metal with spring mounting slots 22, but it is to be understood that wooden cross rails can be used as an alternative to the metal cross rails 20.

The spring assemblage 14 consists of a plurality of first main springs 24 which extend longitudinally of the frame 12 and a plurality of second main springs 26, which extend transversely of the main frame 12. The main springs 24 and 26 are supported intermediate their ends by intermediate springs 28. All of the springs 24, 26, and 28 are formed of spring steel wire and are substantially identical in that each has a generally horizontal body portion located above the frame 12 and a pair of depending end portions which are mounted on the frame 12. Accordingly, only an intermediate spring is illustrated in detail in FIGS. 3, 4, and 5 and only an intermediate spring will be described in detail hereinafter with like numerals indicating like parts on the springs 24, 26, and 28.

As shown in FIGS. 2, 3, 4, and 5, the spring 28 includes a generally horizontal body portion 30 disposed above the frame 12 a distance corresponding to the desired height of the box spring assembly 12, this height normally being the standard height for box springs in the bedding industry. A pair of yieldable end portions 32 extend downwardly from the ends of the body portion 30 and are secured to the frame 12. Each of the end portions 32 has an upper section 34 and a lower section 36 which are located in planes that are upright and generally perpendicular to each other, as clearly appears in FIGS. 4 and 5.

The upper section 34 includes an upper bendable leg 38 that is formed integral at its upper end with a horizontal mounting bar 40. The leg 38 is inclined downwardly and is formed integrally at its lower end with a leg 42 that is also bendable and is inclined at an angle of less than ninety degrees with respect to the upper leg 38. The upper leg 38 and the lower leg 42 are relatively arranged so that the angle therebetween is decreased in response to the application of downwardly directed bedding loads, indicated by the arrow "F" in FIGS. 3, 4, and 5, to the spring assembly 10. The bedding load is the load applied to the box spring assembly 10 when the bed is occupied.

The lower section 36 of the spring end portion 32 has a bendable upper leg 44 which extends at its upper end from the lower end of the upper section 34. The leg 44 is inclined downwardly, as shown in FIG. 4, in the undeflected position of the spring. The section 36 also includes a lower leg 46 which is reversely inclined relative to the leg 44 and extends downwardly from the lower end of the upper leg 44 so that the included angle between the legs 44 and 46 is less than ninety degrees to promote relative bending to the legs 44 and 46 in response to a vertical load F. At its lower end, the leg 46 terminates in a transversely extending torsion bar 48 which forms part of a generally U-shape foot 50 at the lower end of the spring end portion 32, the foot 50 being retained in aligned slots 22 in a cross rail 20.

The spring assemblage 14 also includes, in addition to the main springs 24 and 26 and the intermediate springs 28, a border wire 52 which is generally rectangular in shape corresponding to the shape of the rectangular frame 12, and is spaced a predetermined distance above the frame 12. The main springs 24 have their feet 50 secured by conventional staples 54 to the end rails 18 while the main springs 26 have their feet 50 secured to the cross rails 20 by insertion in the slots 22, as previously described. Similarly, the intermediate springs 28 are mounted on the frame 12 by securing the mounting feet 50 therefor in the slots 22 in adjacent cross rails 20.

The mounting bars 40 at the upper ends of the main springs 24 and 26 are disposed in a side-by-side relation with the border wire 52 and are secured to the border wire 52 by conventional wrap-around-type spring clips 56. Each intermediate spring 28 is secured to adjacent main springs 24 by wrap-around clips 56 extending about the mounting bars 40. The body portion 30 in each intermediate spring 28 is irregularly shaped to form right angle mounting bars 58 adjacent the mounting bars 40 and these bars 58 are also secured by clips 56 to adjacent main springs 26. The result is a rectangular spring deck consisting of the body portions 30 of the springs 24, 26, and 28 and the border wire 52 which is disposed in a horizontal plane above the frame 12 and supported on the spring end portions 32. The end portions 32 resiliently support the deck so that it can yield under bedding loads to accommodate the usual body supporting mattress (not shown) so that the mattress will impart the desired degree of sleeper comfort to the user.

Figure 3:
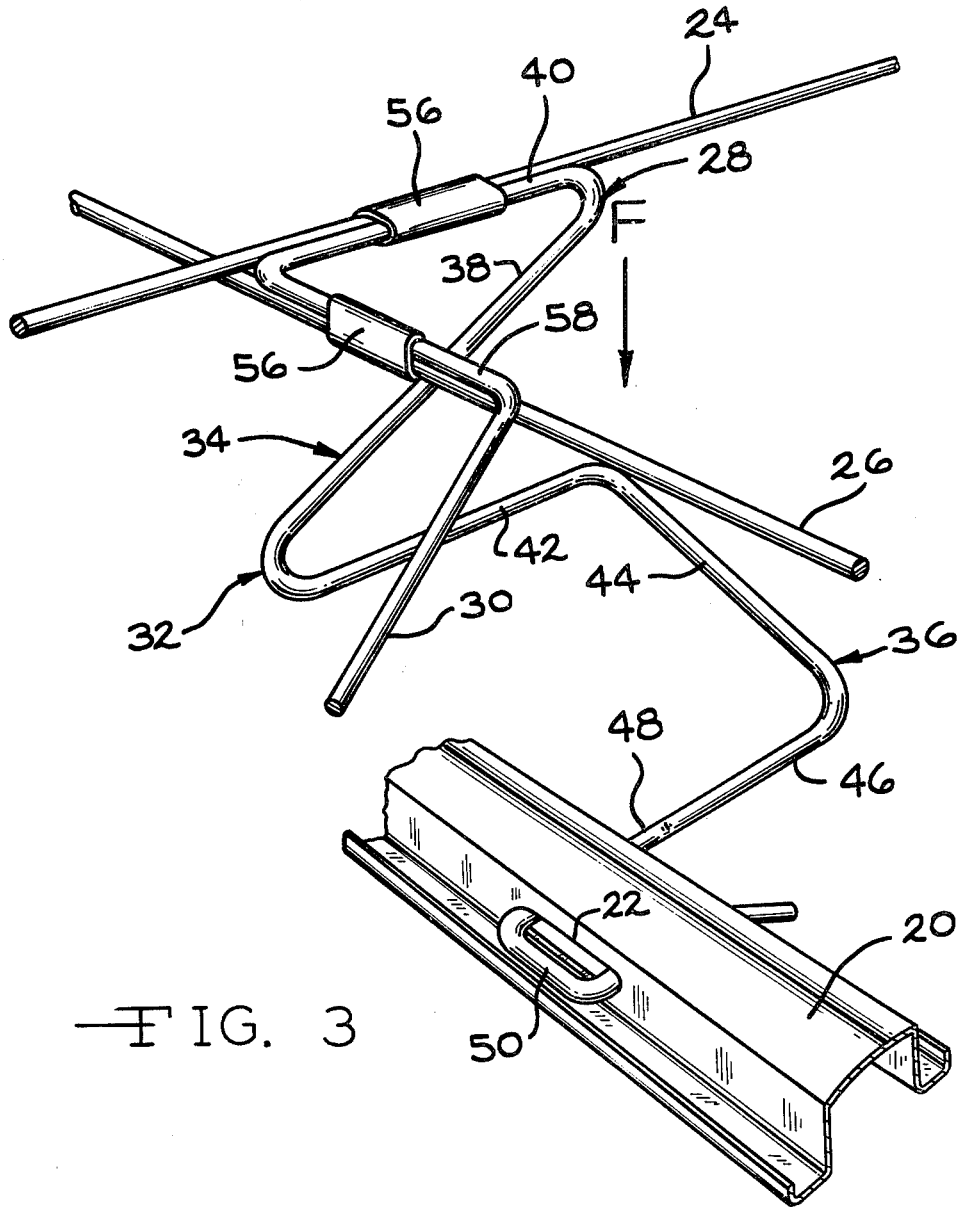
FIG. 3 is a fragmentary perspective view of a portion of the box spring assembly shown in FIG. 1.

In the use of the box spring assembly 10, the loads applied by the mattress occupant will be downwardly directed loads such as indicated by the arrow F in FIGS. 3–5. The load F acts to compress the spring end portions 32, as shown in broken lines in FIGS. 4 and 5. Such movement is resisted by the inherent resistance of the spring end portions 32 to being compressed. However, limited compression of each of the end portions 32 is achieved by movement of the legs 38 and 42 toward each other to reduce the angle therebetween and movement of the legs 44 and 46 toward each other to reduce the angle between these legs. In addition, the torsion bar 48 is twisted and the legs 42 and 44 are twisted with the twisting of these legs also causing twisting of the remaining legs 38 and 46. The result is a spring end portion 32 in which all of the leg components 38, 42, 44, and 46 are both bent and twisted without stressing the end portions 32 beyond their elastic limits so as to induce a "set" in the spring end portions. Each of the legs 38, 42, 44, and 46, in being bent and twisted, has tension stresses induced therein by the bending and shear stresses induced therein by the twisting.

In FIG. 6, the stresses in a spring end portion 32 are indicated diagramatically by superimposing stress-indicating arrows on a cross section of the wire in the end portion 32. Since the shear stresses extend transversely of the wire in the spring end portion 32, shear stress is indicated by the arrow S. Tensile stress, which extends longitudinally of the end portion 32, is indicated by the arrow T. The resultant stress, indicated by the arrow R, is less than the sum of the stresses S and T, as can be clearly seen from the diagram in FIG. 6. Thus, a given amount of spring steel wire in a spring end portion 28 can resist greater loads when the loads are a mixture of bending and torsional loads than when the loads are either all bending or all torsional loads. Further, the closer the bending and torsional loads come to being equal, the higher these loads can be without the resultant stress exceeding the elastic limit of the spring. As a result, the spring end portions 32 in the assembly 10 perform the required function, namely, resilient resistance to bedding load F, with a lesser amount of wire than has herefore been the case. This is due to the configuration of the spring end portions 28 which deflect as shown in broken lines in FIGS. 4 and 5 so that the included angles in the upper section 34 and the lower section 36 are reduced. As shown in FIGS. 4 and 5, the sections 34 and 36 are each in the shape of a V rotated about ninety degrees, with the included angle in each case being less than ninety degrees. This configuration promotes the desired mixture of bending and torsional stresses in the sections 34 and 36.

From the above description, it is seen that this invention provides an improved box spring assembly 10 which will impart the desired degree of firmness to a bedding mattress supported on the spring deck formed by the springs 24, 26, and 28 and the border wire 52. The frame 12 can be structured in a variety of ways to support the spring end portions 32, it being primarily necessary that the frame provide a support for the torsion bars 48 in the end portions 32 which prevents rotation of the bars 48.

What is claimed:

1. In a box spring assembly which includes a generally rectangular frame, a plurality of wire springs mounted on said frame and connected to each other so as to yieldably resist downwardly directed bedding loads, each of said springs being formed of spring steel wire and having an elongated body portion arranged above said frame and downwardly extending end portions, each of said end portions having an upper section and a lower section which are located in planes which are upright and generally perpendicular to each other, said upper section having a bendable upper leg that is inclined downwardly and a lower leg that extends at one end from the lower end of said upper leg, said lower leg being bendable and being inclined at an angle of less than ninety degrees with respect to said upper leg, said legs being relatively arranged so that said angle is decreased in response to the application of downwardly directed load to the upper end of said upper leg, said lower section having a bendable upper leg which extends at one end from the other end of said lower leg, said lower section further including a lower leg which extends downwardly from the other end of the upper leg in said lower section, a torsion bar mounted on said frame and formed integral with the lower end of the lower leg in said lower section, and means mounting said torsion bar on said frame, said legs in said lower section being relatively inclined so that the included angle therebetween is less than ninety degrees, so that in response to said bedding load on said upper section, at least some of said legs are stressed so as to resist said load with both shear and tensile stresses.

2. The structure according to claim 1 further including a border wire of generally rectangular shape disposed above and in general alignment with said rectangular frame, mounting bars at the upper ends of the end portions for at least some of said springs arranged side by side with said border wire, and wraparound clip means connecting said mounting bars to said border wires.

3. The structure according to claim 1 wherein said lower leg in each of said upper sections is substantially horizontal in the undeflected position of said spring end portions.

4. In a box spring assembly which includes a generally rectangular frame, a plurality of wire springs mounted on said frame and connected to each other so as to yieldably resist downwardly directed bedding loads applied to said springs, each of said springs being formed of spring steel wire and having an elongated body portion arranged above said frame and downwardly extending end portions, each of said end portions having an upper section and a lower section which are located in planes which are upright and generally perpendicular to each other, each of said sections being comprised of integral legs arranged in a generally V-formation rotated about ninety degree with the included angle between the legs being less than ninety degrees, said included angle being decreased in response to the application of a downwardly directed bedding load to the upper end of said end section, said lower section terminating in a torsion bar secured to said frame and at least some of said legs being subjected to both bending and torsional loads in response to said bedding load.

5. The structure according to claim 4 wherein the lower leg in each of said upper sections is disposed in a substantially horizontal position in the undeflected position of said spring end portions.

6. A wire spring for a box spring assembly, said spring being formed of a single strip of spring steel wire and comprising an elongated generally horizontal body portion having downwardly extending end portions, each of said end portions having an upper section and a lower section which are located in planes which are upright and generally perpendicular to each other, said upper section having a blendable upper leg that is inclined downwardly and a lower leg that extends at one end from the lower end of said upper leg, said lower leg being bendable and being inclined at an angle of less than ninety degrees with respect to said upper leg, said legs being located in one of said planes and being relatively arranged so that said angle is decreased in response to the application of downwardly directed load to the upper end of said upper leg, said lower section having a bendable upper leg which extends at one end from the other end of said lower leg, said lower section further including a lower leg which extends downwardly from the other end of the upper leg in said lower section, said upper and lower legs of said lower section being located in the other of said planes, and a torsion bar formed integral with the lower end of the lower leg in said lower section.

* * * * *